United States Patent [19]

Ichida et al.

[11] 4,249,966

[45] Feb. 10, 1981

[54] METHOD OF FORMING A FORSTERITE INSULATING FILM ON THE SURFACE OF A GRAIN-ORIENTED SILICON STEEL SHEET

[75] Inventors: Toshio Ichida; Michiro Komatsubara, both of Chiba; Hiroshi Shimanaka, Funabashi, all of Japan

[73] Assignee: Kawasaki Steel Corporation, Kobe, Japan

[21] Appl. No.: 86,453

[22] Filed: Oct. 19, 1979

[30] Foreign Application Priority Data

Oct. 25, 1978 [JP] Japan ..... 53-131133

[51] Int. Cl.[3] ..... C23C 3/04

[52] U.S. Cl. ..... 148/113; 148/27; 148/31.5

[58] Field of Search ..... 148/113, 27, 31.5

[56] References Cited

U.S. PATENT DOCUMENTS

| | | | |
|---|---|---|---|
| 3,186,867 | 6/1965 | Forslund et al. | 148/113 X |
| 3,841,925 | 10/1974 | Steger | 148/113 |
| 4,168,189 | 9/1979 | Haselkorn | 148/113 |

*Primary Examiner*—Evan K. Lawrence

*Attorney, Agent, or Firm*—Balogh, Osann, Kramer, Dvorak, Genova & Traub

[57] ABSTRACT

A high adhesion uniform forsterite insulating film can be formed on the surface of a grain-oriented silicon steel sheet by the application of an annealing separator consisting mainly of magnesia having a narrow activity distribution defined by the citric acid activity of the magnesia which varies depending upon the variation of final reaction ratio of the magnesia as determined by the method for measuring the citric acid activity of magnesia, where the final reaction ratio of the magnesia is the ratio of that amount of the magnesia which finally reacts with citric acid to the total amount of magnesia mixed with the citric acid.

1 Claim, 4 Drawing Figures

METHOD OF FORMING A FORSTERITE INSULATING FILM ON THE SURFACE OF A GRAIN-ORIENTED SILICON STEEL SHEET

BACKGROUND OF THE INVENTION

1. Field of the Invention

The present invention relates to a method of forming a forsterite insulating film on the surface of a grain-oriented silicon steel sheet.

2. Description of the Prior Art

As a method of forming an insulating film on the surface of a grain-oriented silicon steel sheet, there has generally known a method, wherein a silicon steel sheet is cold rolled into a given final gauge, the cold rolled steel sheet is decarburized at a temperature of 700°–900° C. under a wet hydrogen atmosphere, to form a subscale containing silica on the surface of the steel sheet, an annealing separator consisting mainly of magnesia is applied to the steel sheet surface, and the above treated steel sheet is wound up in the form of a coil and then subjected to a final annealing to form a forsterite insulating film on the surface of the silicon steel sheet.

The forsterite insulating film formed in the above described method has a high influence upon the appearance of the final product. When the film is ununiform, the product cannot be supplied to the market, and therefore the film has a high influence upon the production yield of the product. Particularly, magnesia used as a main component of the annealing separator has a very high influence upon the property of an insulating film, which will be formed during the final annealing, and therefore a large number of investigations have hitherto been carried out.

For example, Japanese Patent Application Publication No. 3,726/66 takes a notice of the particle size of primary particle of magnesia to be used as an annealing separator, and discloses a method, wherein a slurry of magnesia having a particle size of the primary particle of 170–280 Å is applied to the surface of a silicon steel sheet, and a substantially pure magnesium oxide film tightly adhered to the steel sheet surface is formed. Further, Japanese Patent Application Publication No. 14,162/70 discloses a method, which uses magnesia obtained by firing magnesium hydroxide containing not larger than 0.2% of impurity in two stages of low temperature and high temperature, and containing at least 70% of particles having a particle size of not larger than 3μ.

In addition to the above described methods, various proposals have been made with respect to annealing separator. Some of the proposed annealing separators are effective, but they are expensive in the commercial scale mass production. Moreover, since there are various factors having an influence upon the property of annealing separator, the obtained result often lacks reproducibility, and it has been impossible to prevent completely the formation of film, which cannot be used for practical use.

SUMMARY OF THE INVENTION

The object of the present invention is to provide a method of forming a forsterite insulating film, which is more stable and excellent than the conventional method, on the surface of a grain-oriented silicon steel sheet.

The feature of the present invention is the provision of a method of forming a uniform and stable forsterite insulating film on the surface of a grain-oriented silicon steel sheet in a high adhesion, wherein an annealing separator consisting mainly of magnesia is applied on the surface of a grain-oriented silicon steel sheet, the steel sheet is wound up in the form of a coil, and the steel sheet is subjected to a final annealing, an improvement comprising using, as the annealing separator, a low-activity magnesia having a narrow activity distribution defined by a citric acid activity of magnesia, which varies within a range confined by the lines connecting the points A, B, C, D, E, F, G and H shown in FIG. 1 depending upon the variation of the final reaction ratio of the magnesia in the method of measuring the citric acid activity of magnesia by sampling a variant amount of the magnesia, said final reaction ratio of the magnesia being shown by the ratio of the amount of magnesia finally reacted with citric acid to the sampled amount of the magnesia.

DESCRIPTION OF THE PREFERRED EMBODIMENT

Figure 1:
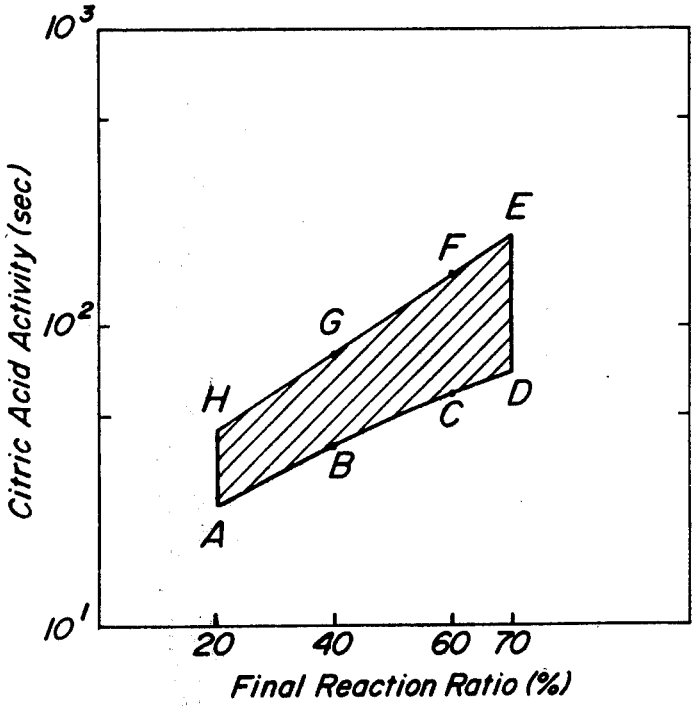
FIG. 1 is a graph illustrating a relation between the final reaction ratio and the citric acid activity of magnesia to be used in the present invention.

The inventors have made a final annealing test by the use of various magnesia, which are different in the purity, particle size, density, specific surface area, citric acid activity, hydration property and the like, as an annealing separator for grain-oriented silicon steel, and found out the following facts with respect to the property of magnesia as an annealing separator for the formation of uniform and stable insulating film.

It is commonly known that the forsterite film-forming reaction is a solid phase reaction between silica, which has been formed just under the surface of a steel sheet during the decarburization annealing process and magnesia applied to the steel sheet surface as an annealing separator. In the solid phase reaction of oxides, the reaction-beginning temperature, reaction rate and other reaction behaviors often vary depending upon the activity of reactants. The inventors have compared the result of the experiments carried out by the use of various magnesia with the specific surface area of the magnesia, which has hitherto been considered as one of the indications for the activity of magnesia, and found out the following facts.

1. When a high-active magnesia (for example, having a specific surface area of more than 30 $m^2/g$) is used, steel sheet surface is not completely covered with forsterite film, and substrate iron surface is exposed and shows a tempered color. Further, even when forsterite is formed, bare spots having a small diameter of 1–2 mm are formed, and an excellent film cannot be formed.

2. When an inactive magnesia (for example, having a specific surface area of less than 7 $m^2/g$) is used, the resulting film is always a thin and whitish film, which is poor in the adhesion and exfoliates when the coated steel sheet is bent in a curvature of as large as at least 50 mm.

3. When magnesia having an intermediate activity (low-active magnesia) is used, the resulting film is superior to the film obtained by the use of the above described high-active or inactive magnesia, and is uniform and excellent in the adhesion. However, exfoliated portion and whitish thin film are sometimes formed, and the yield of good film varies from 50% to 85% depending upon the kind of magnesia used. However, there is no correlation between the yield of good film and the specific surface area of magnesia used.

The above obtained result manifests clearly the technique at present that high-active and inactive magnesia are not proper as an annealing separator, and even when magnesia having an intermediate activity is used, formation of poor film cannot be completely prevented.

The inventors have made various investigations with respect to the properties of the above described magnesia, which has an intermediate activity but gives a film yield scattering from 50% to 85%, in order to find out a property, which has not hitherto been investigated with respect to its correlation to the scattering of film yield but has the correlation, and found out that the above described scattering of film yield has a correlation to the activity distribution of magnesia deduced from the citric acid activity of the magnesia measured by varying a final reaction ratio thereof from 20% to 70%, and that magnesia having a relatively narrow activity distribution, that is, consisting of particles having a relatively uniform activity, is superior in the film yield to magnesia having a wide activity distribution.

An explanation will be made with respect to a method of measuring the citric acid activity of magnesia.

Method of measuring citric acid activity of magnesia:

1. In a 200 cc beaker, a mixture of 100 ml of 0.400 N-citric acid aqueous solution and 2 ml of 1% phenolphthalein indicator is kept at 30° C. A magnetic stirrer is put into the beaker.

2. Magnesia is weighed and put into the beaker. The amount of magnesia to be used is varied corresponding to the final reaction ratio, and when the final reaction ratio is 20%, 4.00 g of magnesia is used; when the ratio is 40%, 2.00 g of magnesia is used; when the ratio is 60%, 1.33 g of magnesia is used; and when the ratio is 70%, 1.14 g of magnesia is used.

3. Just after 10 seconds after the magnesia is put into the beaker, the stirrer is begun to stir. During the stirring, the temperature of the liquid is kept to 30±1° C.

4. The end point of the reaction is shown by the color change of the liquid from white to pink. The time in seconds from the charging of the magnesia to the end point of the reaction is measured, and the number of seconds is defined as the citric acid activity of the magnesia.

The final reaction ratio of magnesia varies depending upon the amount of magnesia charged. Since 100 ml of 0.4 N-citric acid reacts with 0.8 g of magnesia, when 2 g of magnesia is used, the reaction does not complete until 40% of the magnesia is consumed, but when 4 g of magnesia is used, the reaction completes by the consumption of only 20% of the magnesia. When the citric acid activity of a magnesia having a narrow activity distribution is measured, the citric acid activity of the magnesia gradually increases corresponding to the increase of the final reaction ratio. While, in the case where the citric acid activity of a magnesia having a wide activity distribution is measured, when the final reaction ratio is low, magnesia particles having a relatively high activity in the magnesia sample react predominantly with citric acid, but when the final reaction ratio is high, the reaction does not complete unless relatively low-active magnesia particles have been consumed. Therefore, a much longer reaction time is required. Accordingly, when the citric acid activities (numbers of seconds) of magnesia measured at its 20%, 40%, 60% and 70% final reaction ratios are plotted with respect to the final reaction ratios, the activity distribution of the magnesia can be deduced from the inclination of the plotted curve.

Figure 2:
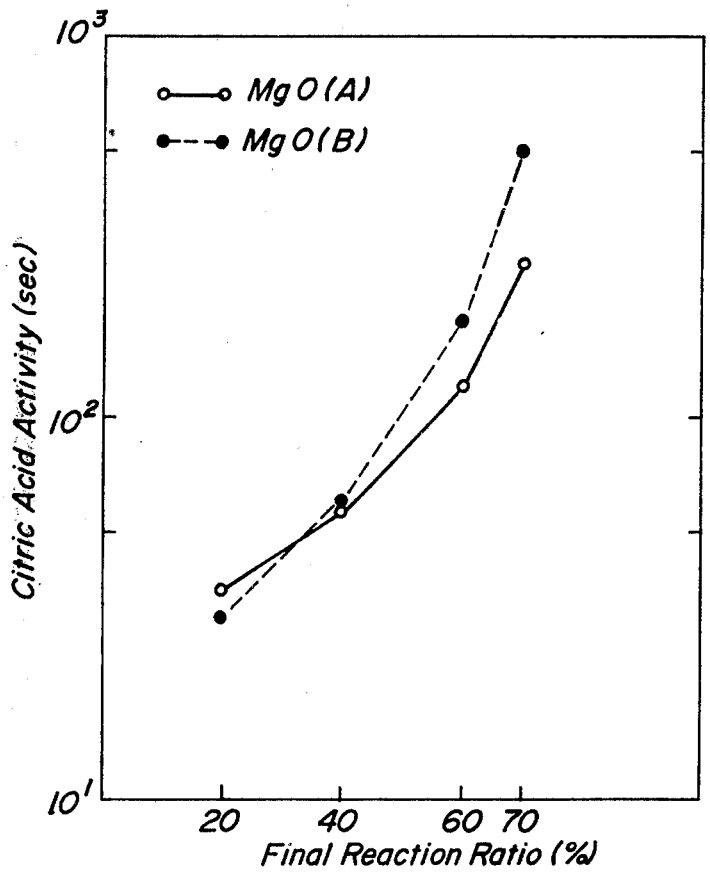
FIGS. 2 and 3 are graphs illustrating a relation between the final reaction ratio and the citric acid activity of magnesia used in the experiments of the present invention.

When the activity distributions of two kinds of magnesia A and B having the same specific surface area were measured by the above described method, although both magnesia had the similar citric acid activity at the 40% final reaction ratio, they were different from each other at the high final reaction ratio as shown in FIG. 2. Magnesia B was larger than magnesia A in the increase of the citric acid activity (number of seconds) towards high reaction ratio side. The reason is that magnesia B has been produced through a firing under a more ununiform temperature and atmosphere condition than the condition in the firing of magnesia A, and has an activity distribution wider than that of magnesia A.

Figure 3:
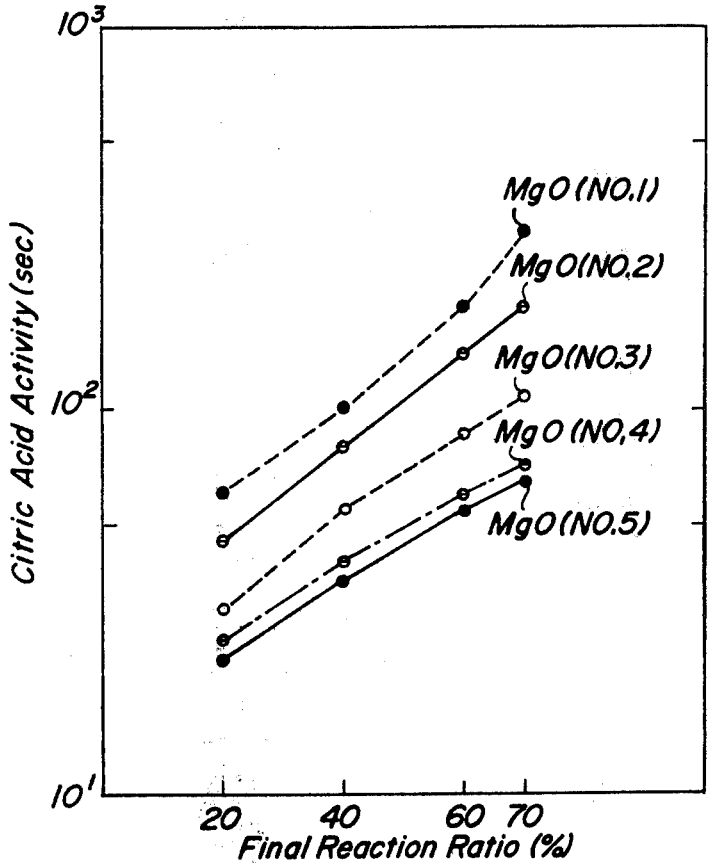

It has been found, from the above described preliminary experiment and the information with respect to the activity distribution of magnesia deduced from the measurement of the citric acid activity, that magnesia, which is neither highly active nor inactive and further has a narrow activity distribution, can form a good film in a high probability. Based on the discovery, the inventors produced magnesia by firing the same raw material magnesium hydroxide under a narrow temperature and atmosphere condition as possible in the following manner. That is, when a rotary kiln is used, the amount of the magnesium hydroxide to be fired per unit time is decreased, and further the kiln is rotated at an increased number of revolutions so as to obtain a uniformly fired magnesia. While, when a muffle furnace is used, the magnesium hydroxide is charged into the muffle furnace not to form a thick stuck, and the fired mass is repeatedly stirred during the firing so as to obtain a uniformly fired magnesia. As the result, all of the resulting magnesia were more uniform than the commonly used magnesia. Therefore, five kinds of magnesia having different activity levels were selected from the resulting magnesia, and properties of these magnesia were examined. Table 1 shows the property of particles of these magnesia. FIG. 3 shows a final reaction ratio dependency of citric acid activity of these magnesia. The term "final reaction ratio dependency of citric acid activity of magnesia" herein used means a citric acid activity of magnesia, which varies depending upon the final reaction ratio of the magnesia.

Table 2 shows the appearance of the surface of the steel sheets obtained by the use of these magnesia as an annealing separator.

In order to show more clearly the result of the film formed on a steel sheet, "occurrence percentage of ununiform film" is described in Table 2 in addition to the appearance of the steel sheet after final annealing. The "occurrence percentage of ununiform film" is the ratio in percentage of the number of blocks having ununiform film to the number of total blocks when a steel strip having a length of more than 3,000 m is divided into blocks every 200 m. That is, the occurrence percentage of ununiform film is shown by the following formula.

$$\text{(Occurrence percentage of ununiform film)} = \frac{\text{(Number of blocks having ununiform film)}}{\text{Number of total blocks}} \times 100$$

In the detection of ununiform film, both sides of the steel sheet were carefully observed.

It can be found from the above described experiments, and as illustrated in FIG. 1, a preferable citric acid activity of magnesia is 25–45 seconds at 20% final reaction ratio, 40–80 seconds at 40% final reaction ratio, 60–150 seconds at 60% final reaction ratio and 70–200 seconds at 70% final reaction ratio.

dependency of citric acid activity as a means for deducing the activity distribution of the magnesia, and have made experiments. As the result, the inventors have succeeded in the formation of a good film in a very high reproducibility by the use of magnesia having a relatively low activity as described above. In the specific surface area and in the size of primary particles measured by the X-ray diffractometry, some of commonly used magnesia may be same with the above described magnesia having a narrow activity distribution. However, these values of a commonly used magnesia are average values in a magnesia consisting of a mixture of particles having a wide particle size distribution (=activity distribution), and therefore the conventional magnesia contains particles, which are suitable for the formation of film, and particles, which are not suitable for

TABLE 1

| Magnesia No. | Specific surface area measured by B.E.T. method ($m^2/g$) | *Size of primary particle measured by X-ray ($\mu$) | Impurities contained (%) | | | | | | | | | |
|---|---|---|---|---|---|---|---|---|---|---|---|---|
| | | | Si | Al | Fe | Ca | C | S | B | P | Na | Cl |
| 1 | 10.2 | 0.20 | | | | | | | | | | |
| 2 | 13.8 | 0.15 | | | | | | | | | | |
| 3 | 20.5 | 0.093 | 0.2 | 0.02 | 0.03 | 0.25 | 0.2 | 0.1 | 0.1 | 0.03 | 0.01 | 0.02 |
| 4 | 25.1 | 0.071 | ±0.1 | ±0.01 | ±0.01 | ±0.15 | ±0.1 | ±0.05 | ±0.05 | ±0.02 | ±0.005 | ±0.01 |
| 5 | 30.3 | 0.060 | | | | | | | | | | |

Note:
*Particle size calculated from the line broadening of X-ray diffraction peak.

TABLE 2

| Magnesia No. | Number of coils coated with magnesia | Appearance of steel sheet surface after final annealing | Occurrence percentage of ununiform film (%) |
|---|---|---|---|
| 1 | 15 | Film is thin as a whole, and crystal grains of iron substrate are observed through the film in some portions. Some of steel strips have whitish weak film in the both side edge portions in a width of more than 30 cm along their lengthwise direction. | 20 |
| 2 | 25 | 23 coils have uniform and even dark grey surface. 2 coils have uneven whitish grey color on the top part of the outermost turn portion. | 5 |
| 3 | 30 | All coils have uniform and even surface. | 0 |
| 4 | 20 | 18 coils have dark grey uniform and even surface. 2 coils have bare spots on the bottom part of the outermost turn portion. | 4 |
| 5 | 20 | Film is thick as a whole and has dark grey color, but bare spots scatter. Some of steel strips have tempered color in the middle portion in the width direction of steel strip. | 25 |

Further, it has been found from above described experiments that, when magnesia having a too high activity (for example, magnesia No. 5) is used, the resulting film is thick and very uneven and exfoliates in some portions. Therefore, the steel sheet is poor in the commercial value. While, when magnesia having a too low activity (for example, magnesia No. 1) is used, the resulting film is generally whitish, and poor in the adhesion. Such kind of magnesia is probably too low in the reactivity with silica to form a forsterite film.

The inventors have prepared uniform magnesia having an activity distribution narrower than that of conventional magnesia by utilizing the final reaction ratio the formation of film, and it is probably impossible to form a good film in a high reproducibility. On the contrary, the magnesia, which is newly found out by the inventors, has a very narrow activity distribution defined by the final reaction ratio dependency of citric acid activity, and further has an activity suitable for proceed moderately a forsterite-forming reaction. Therefore, a uniform forsterite film having a good adhesion can be formed by th use of the magnesia.

The inventors have further found in the above experiment that, magnesia having a purity of $CaO<0.50\%$, $Cl\leqq0.04\%$, $SiO_2<0.15\%$, $SO_3<0.20\%$, $R_2O_3<0.20\%$ and B<0.15% and having an MgO content of at least 95% can be used as an annealing separator without any troubles.

Further, the sedimenting particle size, sieving particle size, bulk density and the like, which vary due to the aggregation of primarily particles, have an influence upon the fluidity of magnesia, the dispersibility and applicability of magnesia slurry, and the shape of coil applied with magnesia. However, these properties do not directly influence the forsterite-forming reaction itself.

Further, even when uniform magnesia having a narrow activity distribution newly found out by the inventors was used together with various additives, such as titania, manganese oxide, chromic oxide and the like, the effect of the magnesia as an annealing separator did not deteriorate.

The following example is given for the purpose of illustration of this invention and is not intended as a limitation thereof.

EXAMPLE

A silicon steel strip containing 0.025% of C, 3.2% of Si and having a thickness of 0.3 mm, a width of 970 mm and a length of 3,500 m was continuously annealed and decarburized at 820° C. for 2.4 minutes under a gas atmosphere consisting of 70% of $H_2$ and the remainder being $N_2$ and having a dew point of 60° C., applied with magnesia as an annealing separator, and then wound up on a coil. The coil was put into a box-type electric furnace, heated at a temperature-raising rate of 20° C./hr., while flowing hydrogen gas, annealed at 1,200° C. for 20 hours, and then cooled in the furnace. The obtained result is shown in the following Table 3.

In the above described experiment, each of magnesia Nos. I–V was mixed with pure water in a mixing ratio of magnesia/water of from 10 kg/100 l to 15 kg/100 l to prepare a slurry and the slurry was kept at a temperature of not higher than 20° C., and applied to the steel strip by means of a roll coater.

Magnesia No. I

Figure 4:
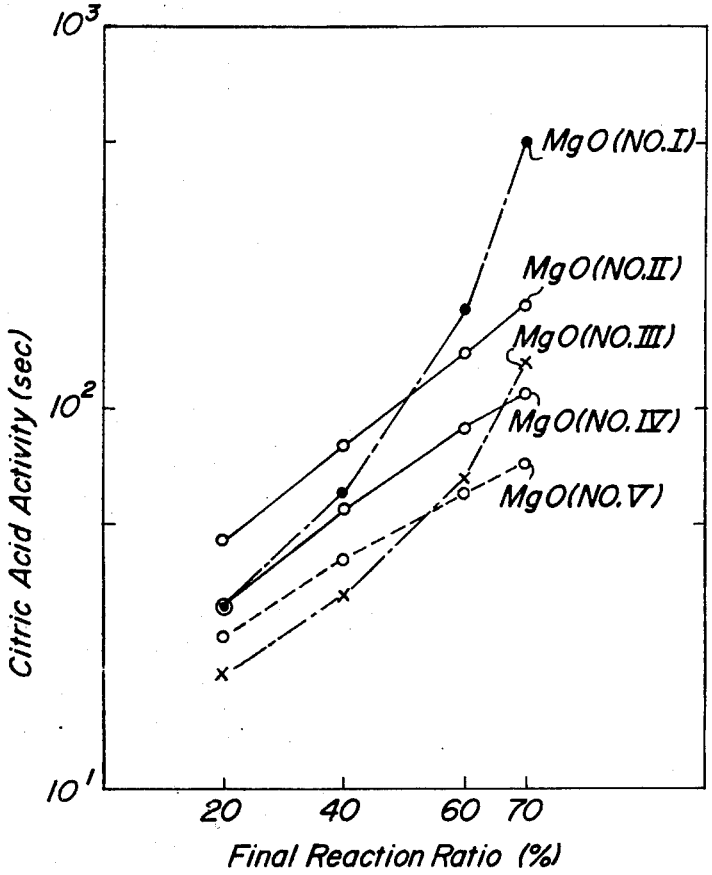
FIG. 4 is a graph illustrating a relation between the final reaction ratio and the citric acid activity of magnesias used in the example in the present invention.

Dried magnesium hydroxide was granulated, charged into a muffle furnace in a thickness of about 20 cm, and fired by means of an oil burner. During the firing, the temperature of the fired mass rose up to about 1,000° C. at the surface and about 850° C. at the bottom. After the firing, the mass was pulverized and sieved. The resulting magnesia powder had a specific surface area of 13.2 $m^2/g$ and a final reaction ratio dependency of citric acid activity shown in FIG. 4.

Magnesia No. II

In the same manner as described above, granules of dried magnesium hydroxide was charged into a muffle furnace in a thickness of about 20 cm, and fired by means of an oil burner. During the firing, the fired mass was stirred twice by means of an agitating blade so as to be mixed homogeneously. During the firing, the temperature of the fixed mass rose up to about 950° C. at the surface and about 850° C. at the bottom. The resulting magnesia powder had a specific surface area of 13.8 $m^2/g$ and a final reaction ratio dependency of citric acid activity shown in FIG. 4. Accordingly, this magnesia has an activity distribution ranging within the range defined in the present invention.

Magnesia No. III

Dried basic magnesium hydroxide was granulated, charged into a muffle furnace in a thickness of about 20 cm, and fired by means of an oil burner. During the firing, the temperature of the fired mass rose up to about 950° C. at the surface and about 800° C. at the bottom. After the firing, the fired mass was pulverized and sieved. The resulting magnesia powder had a specific surface area of 33.1 $m^2/g$ and a final reaction ratio dependency citric acid activity shown in FIG. 4.

Magnesia No. IV

Dried magnesium hydroxide was granulated, and fired at 900° C. in a rotary kiln. In the firing, the kiln was arranged at a small inclination angle and rotated at an increased number of rotations, and the magnesium hydroxide was charged into the kiln in a small amount per unit time so as to be heated uniformly. The resulting magnesia powder had a specific surface area of 20.5 $m^2/g$ and a final reaction ratio dependency of citric acid activity shown in FIG. 4. Accordingly, this magnesia has an activity distribution ranging within the range defined in the present invention.

Magnesia No. V

In the same manner as described in the production of magnesia No. IV, magnesium hydroxide was fired at 850° C. in a rotary kiln. Further, the temperature of the fired mass and the firing atmosphere were kept uniform in the same procedure as described in the production of magnesia No. IV. The resulting magnesia powder had a specific surface area of 25.1 $m^2/g$ and a final reaction ratio dependency of citric acid activity shown in FIG. 4. Accordingly, this magnesia has an activity distribution ranging within the range defined in the present invention.

TABLE 3

| Magnesia No. | Number of coils coated with magnesia | Appearance of steel sheet surface after final annealing | Occurrence percentage of ununiform film (%) |
|---|---|---|---|
| I (Comparative magnesia) | 4 | Thin film is formed on the inner surface of the outermost turn portion, and crystal grains of iron substrate are observed through the thin film. Film has some ununiform portions wherein whitish film and dark grey film are alternately formed. | 35 |
| II (Magnesia of the present invention) | 25 | 23 coils have uniform and even dark grey surface. 2 coils have uneven whitish grey color on the top part of the outermost turn portion. | 5 |

TABLE 3-continued

| Magnesia No. | Number of coils coated with magnesia | Appearance of steel sheet surface after final annealing | Occurrence percentage of ununiform film (%) |
|---|---|---|---|
| III (Comparative magnesia) | 4 | Film has a dark grey color, but bare spots scatter. Some portions of steel strip surface have no film and have tempered color. | 65 |
| IV (Magnesia of the present invention) | 30 | All coils have uniform and even surface. | 0 |
| V (Magnesia of the present invention) | 20 | 18 coils have dark grey uniform and even surface. 2 coils have bare spots on the innersurface of the outermost turn portion. | 4 |

As described above, according to the present invention, a uniform and highly adhesive forsterite film can be stably formed on a steel sheet surface.

What is claimed is:

1. In a method of forming a forsterite insulating film on the surface of a grain-oriented silicon steel sheet in a high adhesion, wherein an annealing separator consisting mainly of magnesia is applied on the surface of a grain-oriented silicon steel sheet, the steel sheet is wound up in the form of a coil, and the steel sheet is subjected to a final annealing, the improvement comprising using, as the annealing separator, a low-activity magnesia having a specified narrow activity distribution defined by a citric acid activity of magnesia, which varies within the range confined by the lines connecting the points A, B, C, D, E, F, G and H shown in FIG. 1 depending upon the variation of the final reaction ratio of the magnesia as determined by the method of measuring the citric acid activity of magnesia by mixing varying amounts of the magnesia with citric acid, said final reaction ratio of the magnesia being the ratio of the amount of magnesia finally reacted with citric acid to the total amount of the magnesia mixed therewith, said low-activity magnesia having citric acid activity which varies within the ranges defined by the following values:

| Final reaction ratio | Citric acid activity |
|---|---|
| 20% | 25–45 seconds |
| 40% | 40–80 seconds |
| 60% | 60–150 seconds |
| 70% | 70–200 seconds |

* * * * *